US006715698B2

(12) United States Patent
Foster et al.

(10) Patent No.: US 6,715,698 B2
(45) Date of Patent: Apr. 6, 2004

(54) MANUALLY OPERABLE TRIGGER SPRAYER WITH REARWARDLY LOCATED SPRAYER VALVE

(75) Inventors: Donald D. Foster, St. Charles, MO (US); Philip L. Nelson, Wildwood, MO (US)

(73) Assignee: Continental AFA Dispensing Company, St. Peters, MO (US)

( * ) Notice: Subject to any disclaimer, the term of this patent is extended or adjusted under 35 U.S.C. 154(b) by 0 days.

(21) Appl. No.: 10/303,623

(22) Filed: Nov. 25, 2002

(65) Prior Publication Data

US 2003/0098368 A1 May 29, 2003

Related U.S. Application Data

(63) Continuation-in-part of application No. 09/990,314, filed on Nov. 23, 2001.

(51) Int. Cl.[7] ..... B05B 7/30

(52) U.S. Cl. ..... 239/343; 239/333; 239/353; 239/491

(58) Field of Search ..... 239/333, 343, 239/353, 340, 491, 492

(56) References Cited

U.S. PATENT DOCUMENTS

| | | | | |
|---|---|---|---|---|
| 4,527,594 A | | 7/1985 | Garneau | |
| 4,558,821 A | * | 12/1985 | Tada et al. | 239/333 |
| 4,953,791 A | * | 9/1990 | Tada | 239/333 |
| 5,158,233 A | * | 10/1992 | Foster et al. | 239/333 |

* cited by examiner

*Primary Examiner*—Steven J. Ganey
(74) *Attorney, Agent, or Firm*—Thompson Coburn LLP

(57) ABSTRACT

A trigger sprayer valve assembly that has a conical flange that controls the flow of liquid in a downstream direction through a liquid passage of the trigger sprayer. The valve is constructed with an elongate stem or shaft that facilities the assembly of the valve into the trigger sprayer and a positioning plug that solely holds the valve in a centered position in the liquid passage of the trigger sprayer.

18 Claims, 13 Drawing Sheets

MANUALLY OPERABLE TRIGGER SPRAYER WITH REARWARDLY LOCATED SPRAYER VALVE

This patent application is a continuation-in-part of patent application Ser. No. 09/990,314, titled Telescoping Foamer Nozzle, filed Nov. 23, 2001 and presently pending.

BACKGROUND OF THE INVENTION (1) Field of the Invention

The present invention pertains to a valve of a manually operable trigger sprayer. In particular, the present invention pertains to a trigger sprayer valve positioned in a liquid passage communicating the pump of the sprayer with the nozzle exit port of the sprayer where the valve is constructed with a flexible, conical flange that controls the flow of liquid through the trigger sprayer in the downstream direction while preventing return, upstream liquid flow. In addition, the valve is constructed with an extended shaft projecting from the conical flange that facilitates the assembly of the valve into the sprayer housing of the trigger sprayer.

(2) Description of the Related Art

The prior art related to atomizers and trigger sprayers includes the following U.S. Patents.

U.S. Pat. No. 1,900,087 to Aronson teaches an atomizer in which the operating elements are locked when the device is not in use, thereby preventing objectionable unintentional discharge of the contents of the atomizer.

U.S. Pat. No. 3,913,841 to Tada shows a sprayer which applies a suction to a liquid and dispenses or squirts the liquid in an atomized form by applying a pressure to the liquid. The sprayer includes a piston which defines a liquid chamber in combination with a cylinder portion of the sprayer. When the piston is reciprocated and moved into proximity to a closed end wall of the cylinder, the volume of the liquid chamber formed by the piston and cylinder is minimized, thereby resulting in a high pressure discharge or squirting of the liquid from the chamber.

U.S. Pat. No. 4,646,973 to Focaracci shows a sprayer for producing a foam from a spray of liquid mixed in air. An interrupter is located in the path of a controlled portion of the outer periphery of a continuous stream of liquid dispensed by the sprayer. By controlling the amount of peripheral flow of the liquid impinged upon by the interrupter in the stream periphery, turbulence is created in the liquid with consequent pressure drop and ingress of counter-flowing ambient air which mixes with the liquid and causes foaming of the liquid dispensed by the sprayer.

U.S. Pat. No. 4,991,779 to Blake shows a device for producing foam from liquid dispensed from the device which incorporates a porous element.

U.S. Pat. No. 5,156,307 to Calillahan et al. shows a dispenser which has a circular mixing chamber positioned intermediately in front of a mixing nozzle. A first channel leads into the mixing chamber from material located in a squeezable container. A second channel leads into the mixing chamber from an air space. A sieve covers the outlet channel.

U.S. Pat. No. 5,158,233 to Foster et al. shows a nozzle assembly with a foam-inducing tube in front of the nozzle outlet orifice. A door is provided with an elongated pin having a convex tip for sealing the outlet orifice.

U.S. Pat. No. 5,340,031 to Neuhaus et al. shows a foaming head and includes a discharge nozzle which has a deflecting plate having passage slits which open out radially to an outlet slit.

U.S. Pat. No. 5,344,070 to Tasaki et al. shows a foaming nozzle which is shaped so that the foam is ejected in the form of a band which may be elliptical, rectangular or triangular in shape. The foam is formed by the impingement of a liquid mist upon an inner face of the mouth of the foaming nozzle.

U.S. Pat. No. 5,366,160 to Balderama shows a foamer nozzle which incorporates opposing pairs of spaced apart looped ribs which are in a plane downstream from the discharge orifice. The ribs are tear-dropped shaped in cross section and have a pair of spaced legs which define an opening.

U.S. Pat. No. 5,540,389 to Knickerbocker shows an orifice device which incorporates a spin chamber communicating with the terminal orifice. A plurality of feed channels communicate with this spin chamber for the purpose of spinning the spray product within the spin chamber prior to discharge.

U.S. Pat. No. 5,647,539 to Dobbs et al. shows an assembly which incorporates a foam enhancer chamber having a plurality of ribs which define uniform openings. The ribs have flat surfaces which are perpendicular to the inner wall of the chamber for the purpose of generating foam as foam bubbles impact against the ribs to mix with air.

Despite the various developments in the prior art, there remains a need for a nozzle which can easily and reversibly switch from operation in a foam dispensing mode to operation in a spray dispensing mode. In addition, there remains a need for a valve of a trigger sprayer that controls the flow of liquid in a downstream direction from the manually operated pump of the trigger sprayer to the nozzle exit port of the trigger sprayer while preventing the reverse direction flow of liquid through the trigger sprayer where the valve is constructed to be easily assembled into a liquid passage of the trigger sprayer housing.

SUMMARY OF THE INVENTION

The present invention provides a telescoping foamer nozzle which can be easily and reversibly switched from a foam dispensing mode of operation to a spray dispensing mode of operation.

The present invention also provides a telescoping foamer nozzle in which a foamer tube projects forward of a dispensing orifice when in the foam dispensing mode of operation.

The present invention also provides a telescoping foamer nozzle that has a relatively small number of component parts resulting in reliable long-term operation.

The present invention also provides a telescoping nozzle that has a relatively small number of component parts which can be manufactured easily in volume resulting in a relatively low unit cost.

The present invention also provides a valve that controls the flow of liquid in a downstream direction from a pump of the trigger sprayer to a nozzle exit port of the trigger sprayer where the valve is constructed to be easily assembled into the trigger sprayer.

The present invention also provides a sprayer housing construction with a liquid discharge passage that is easily assessable through a liquid discharge opening in the sprayer housing that communicates with the liquid discharge passage for assembly of the valve of the invention into the liquid discharge passage.

The present invention also provides the valve with an extended stem or shaft that has a length that extends the shaft beyond the liquid discharge passage opening of the sprayer housing when the valve is assembled into the liquid discharge passage, facilitating the assembly of the valve into the liquid discharge passage.

These and other advantages of the present invention will appear more clearly hereinafter.

In accordance with the present invention, there is provided a telescoping foamer nozzle which includes a nozzle member which has a feed tube connected to a supply of spray material. A cap member is rotationally mounted on the nozzle member. The cap member may be rotated relative to the nozzle member from an off-position to a foam-position with continued rotation in the same direction bringing the cap member to a spray-position and then a second foam-position and then to the off-position. The cap member supports a foam tube which includes a cam boss which engages a cam groove formed in the nozzle member.

Rotation of the cap member drives the foam tube. The cam groove and cam boss drive the foam tube from a retracted position in which the cap member is in one of its off-position or spray-position, to an extended position projecting forward of the discharge nozzle in which the cap is in one of its two foam-positions. The cap includes indicia which clearly mark the off-position, the foam-position, the spray-position and the further foam-position. The cap is proportioned to fit flush against the nozzle in each of the operating positions.

BRIEF DESCRIPTIONS OF THE DRAWING FIGURES

Further features of the invention are revealed in the following detailed description of the preferred embodiment of the invention and in the drawing figures wherein.

DETAILED DESCRIPTION OF A PREFERRED EMBODIMENT

Figure 1:
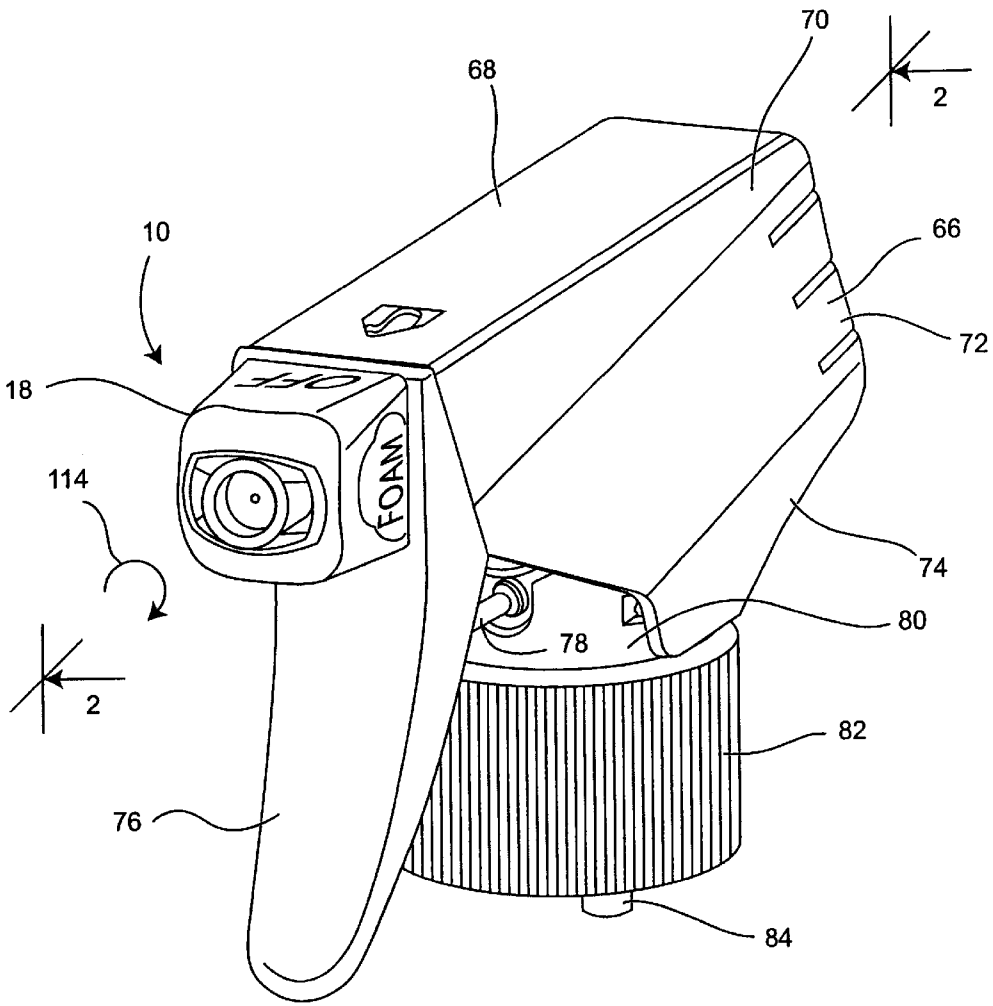
FIG. 1 is an overall perspective view of a telescoping foamer nozzle made in accordance with the present invention, with the telescoping foamer nozzle shown mounted on a spray canister.
Figure 2:
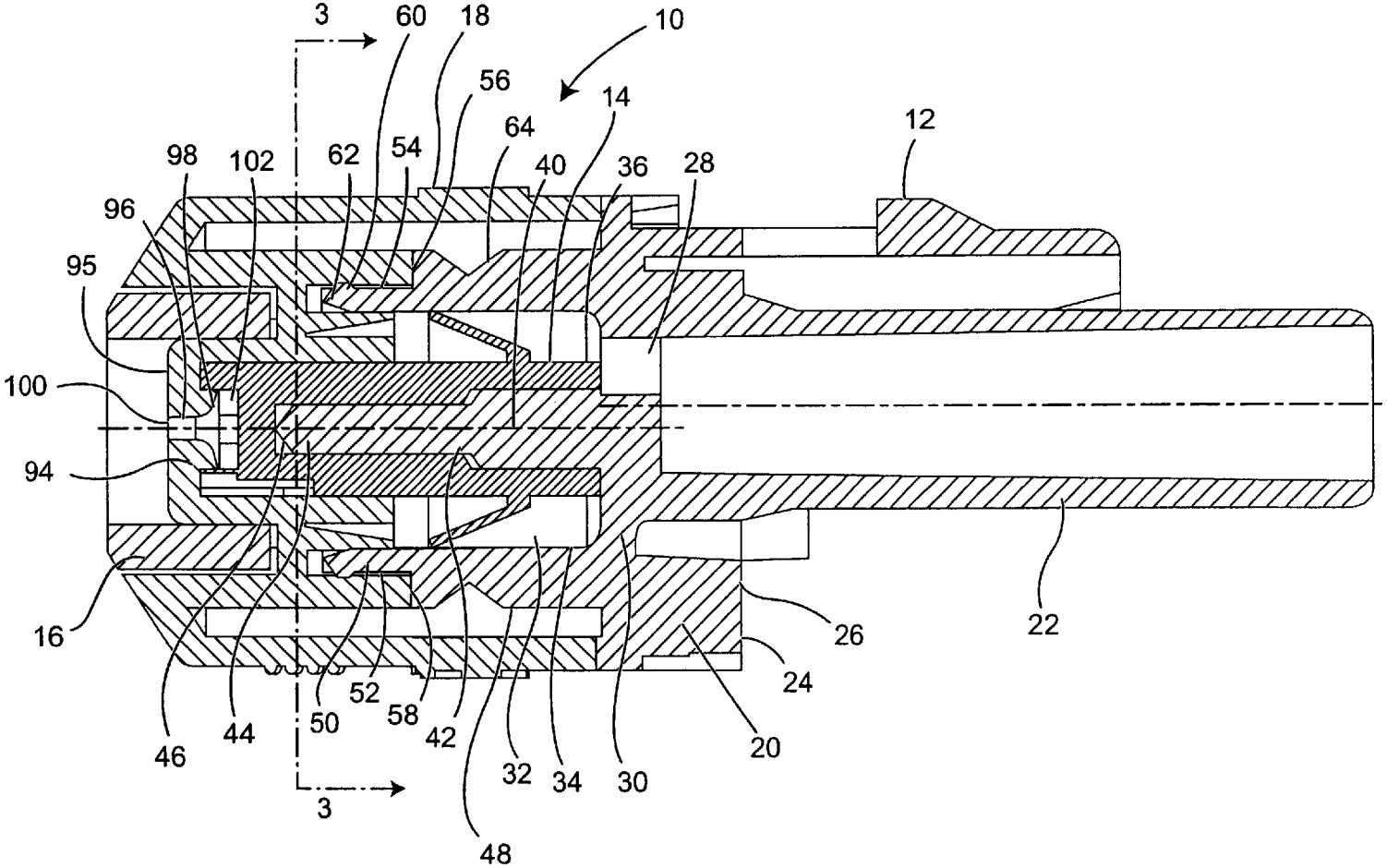
FIG. 2 is a cross-sectional view taken along the line 2—2 of FIG. 1 showing the components in the off-position.

With reference to the drawings, in which like reference numbers designate like or corresponding parts throughout, there is shown in FIGS. 1 and 2 a telescoping foamer nozzle generally designated by the reference number 10, made in accordance with the present invention, which includes a nozzle member 12, a liquid spinner member 14, a foamer tube 16 and cap member 18.

As shown in FIG. 2, the nozzle member 12 is an intricately formed component which includes a central portion 20 and a centrally disposed feed tube 22 which projects from a rear surface 24 of the central portion. The feed tube 22 communicates via a port 28 formed in a center wall 30 of the central portion 20 with a cavity 32 on the opposite side of the central wall 30 from the feed tube 22. The cavity 32 is defined by a cylindrical wall having lower 34 and upper 36 interior surfaces that project from the center wall 30.

A shaft 40 projects from the center wall 30. The shaft 40 is centrally located with respect to the interior surfaces 34, 36 of the cylindrical wall. The shaft 40 has a stepped portion 42, a generally square cross section, and the end 44 of the shaft 40 is formed as a conical point 46.

Figure 6:
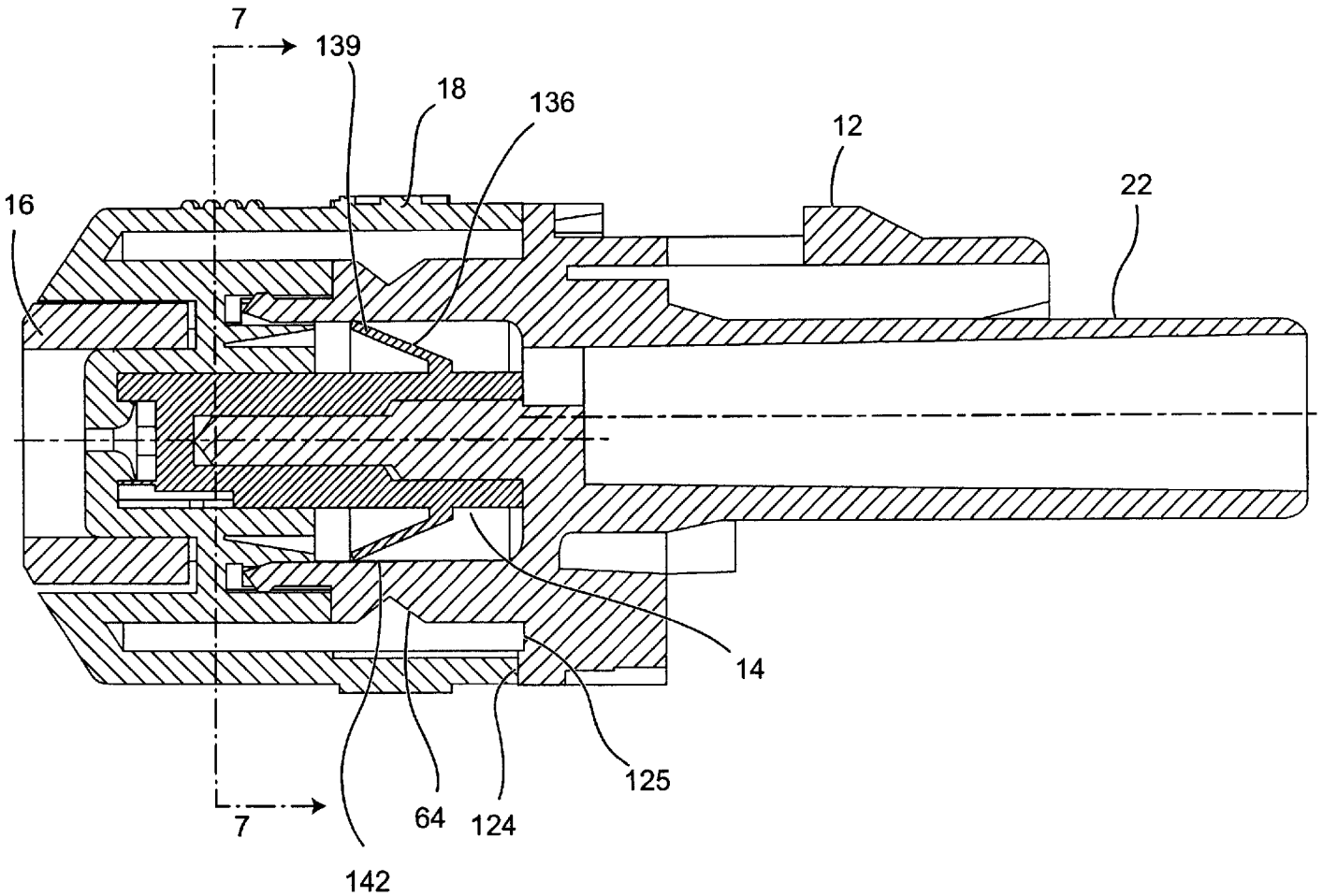
FIG. 6 is a cross-sectional view taken along the line 2—2 of FIG. 1, similar to FIG. 2 but showing the components in the spray-position.

An outside surface 48 of the cylindrical wall has a stepped portion 50 which is defined by lower 52 and upper 54 cylindrical wall portions and upper 56 and lower 58 annular wall portions. The cylindrical wall portions 52, 54 have an integrally formed annular collar 60 which retains the cap member 18 in a manner which will be presently described. A front portion 62 of the cylindrical wall portions 52, 54 is tapered to facilitate the ease of assembly of the cap member 18 onto the nozzle assembly 12. An outer cylindrical surface 48 adjacent the cylindrical wall portions 52, 54 includes an annular cam groove 64 which forms a key feature of the present invention. The cam groove 64 is shown in cross section in FIGS. 2, 4 and 6 and in perspective in FIG. 9.

FIG. 1 shows the nozzle member 12 encased in a trigger sprayer housing 66 that includes a top panel 68 and side panels 70, 72, 74. The telescoping foamer nozzle 10 is operated by a trigger 76 that is connected by a plunger 78 or piston rod to a piston in a pump cylinder (not shown) contained in the sprayer housing 80. A cap 82 is attached to the sprayer housing 80 and is used in attaching the sprayer housing to a bottle container containing a liquid to be dispensed by the trigger sprayer. A dip tube 84 extends downwardly from the sprayer housing 80 and communicates with the pump chamber in the sprayer housing. When the cap 82 is attached to the liquid container, the dip tube 84 extends downward into the liquid contained in the container communicating the liquid with the pump chamber of the trigger sprayer. The trigger 76 and plunger 78 are conventional in nature and, therefore, have not be illustrated or described in detail.

The nozzle cap 18 is a hollow member that has exterior side wall portions 86, 88, 90, 92 and an exterior front wall portion 95. The cap member 18 includes an inwardly projecting generally cylindrical portion 94 that has a central nozzle 96. The nozzle 96 includes a converging portion 98 that communicates with an exit port 100 of the nozzle. The converging portion 98 also communicates with a central bore 102 in the nozzle cap. The central bore 102 accommodates the shaft 104 of the liquid spinner member 14.

The projecting portion 94 of the nozzle cap includes an annular, V-shaped groove 106 and an annular, rectangular cross section groove 108. The V-shaped groove 106 provides a degree of flexibility in the cylindrical portion 110 of the cap adjacent to the rectangular groove 108. The rectangular groove 108 includes an undercut portion 112 that receives the collar 60 formed on the nozzle member 12. The V-shaped groove 106 allows the cap member 18 to be snapped onto the collar 60 and allows the cap member 18 to rotate relative to the nozzle member 12 as is shown by the arrow 114 in FIG. 1. The exterior side wall portions of the cap 86, 88, 90, 92 are proportioned to closely match the exterior surfaces 116, 118, 120, 122 of the nozzle member 12 and the end surface 124 of the cap 18 abuts the end surface 125 of the nozzle member 12.

The liquid spinner member 14 includes a central portion 126 that has a square cross section interior bore 128 that fits on the square shaft 40 of the nozzle assembly. The nozzle assembly square shaft 40 and the square interior bore 128 prevent the rotation of the liquid spinner member 14 relative to the nozzle assembly shaft 40. The end 129 of the interior bore 128 abuts the conical point 46 on the nozzle assembly shaft 40. The liquid spinner member 14 includes an integrally formed tapered flange portion 136 that functions as a valve.

The valve flange portion 136 has the overall configuration of a hollow cone. A circular outer peripheral edge 139 of the conical flange portion 136 is proportioned to form an interference fit with the interior surface of the bore 142.

The conical flange portion 136 is relatively thin and is molded in a relatively flexible plastic material. This construction results in a degree of flexibility of the conical flange portion 136 in the radial inward direction as shown by the arrow 144 in FIG. 10. This flexibility enables liquid spray material to flow past the conical flange portion 136 as is shown by the arrows 146, 147, 148 in FIGS. 10 and 11, and prevents the reverse flow of air in the opposite direction as shown by the arrow 149 in FIG. 10.

The flexible conical flange portion 136 and the interior bore 142 thus form a bias-closed valve. During use, the liquid spray material flows past the conical flange portion 136.

Figure 3:
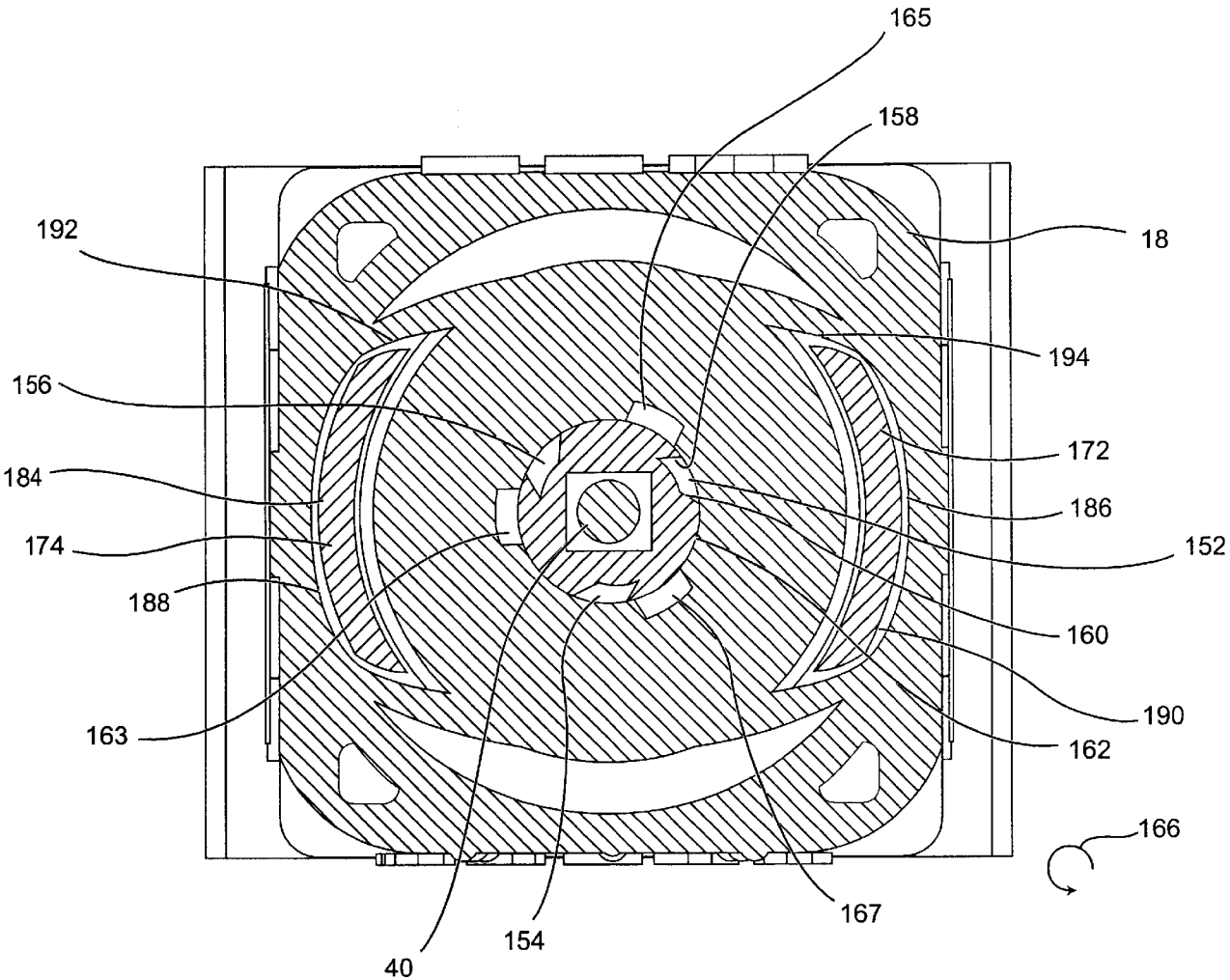
FIG. 3 is a cross-sectional view taken along the line 3—3 of FIG. 2.
Figure 9:
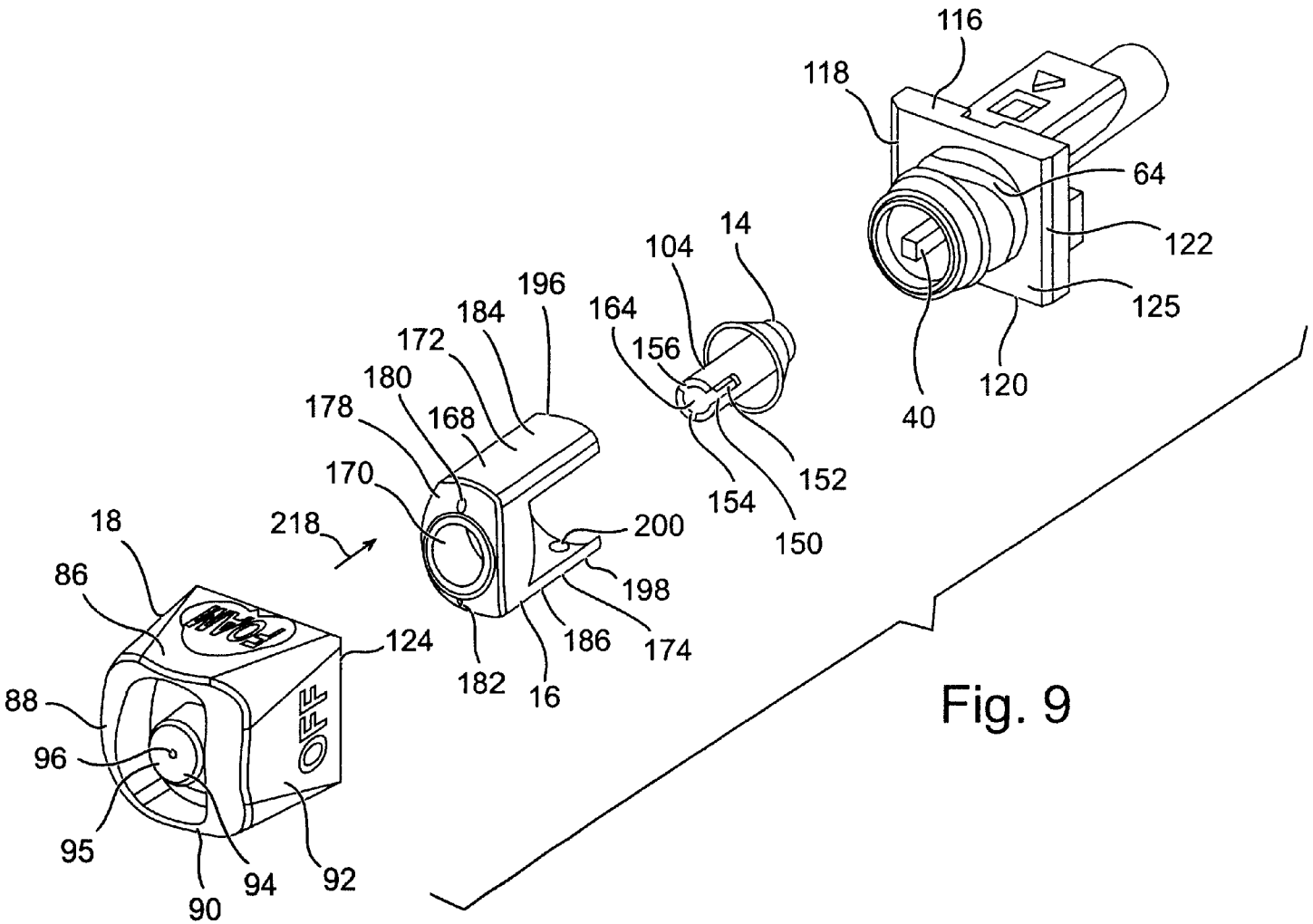
FIG. 9 is an exploded perspective view showing the various components of the trigger sprayer.

As is shown in FIG. 9, the end face portion 150 of the liquid spinner member 14 includes three grooves or apertures 152, 154, 156. Each aperture is defined by a pair of opposing side walls 158, 160 as shown in FIG. 3. Each side wall 158 forms an acute angle with the surface 162 and each side wall 160 forms an obtuse angle with the surface 162. During use, the liquid spray material flows through the channels 163, 165, 167 and enters the spinner cavity 164. The angular orientation of the side walls 158, 160 causes the spray material to enter the spinner cavity 164, which is relatively small, in a generally tangential direction with reference to the surface 162 thereby causing the rotation of the liquid spray material entering the spinner cavity 164 and thereby resulting in atomization of the flow of liquid spray material discharged through the nozzle exit port.

The foamer tube 16 includes a central portion 168 that includes a central bore 170 and a pair of guide legs 172, 174 as best shown in FIG. 9. The central portion 170 accepts the end portion 176 of the nozzle member 12. The outer surface 178 of the foamer tube 16 has a pair of air openings 180, 182 that extend through the central portion 168. The outer surfaces 184, 186 of the guide legs 172, 174 are generally curved and are proportioned to slide within complementary curved portions 188, 190 of the cap member 18.

Figure 10:
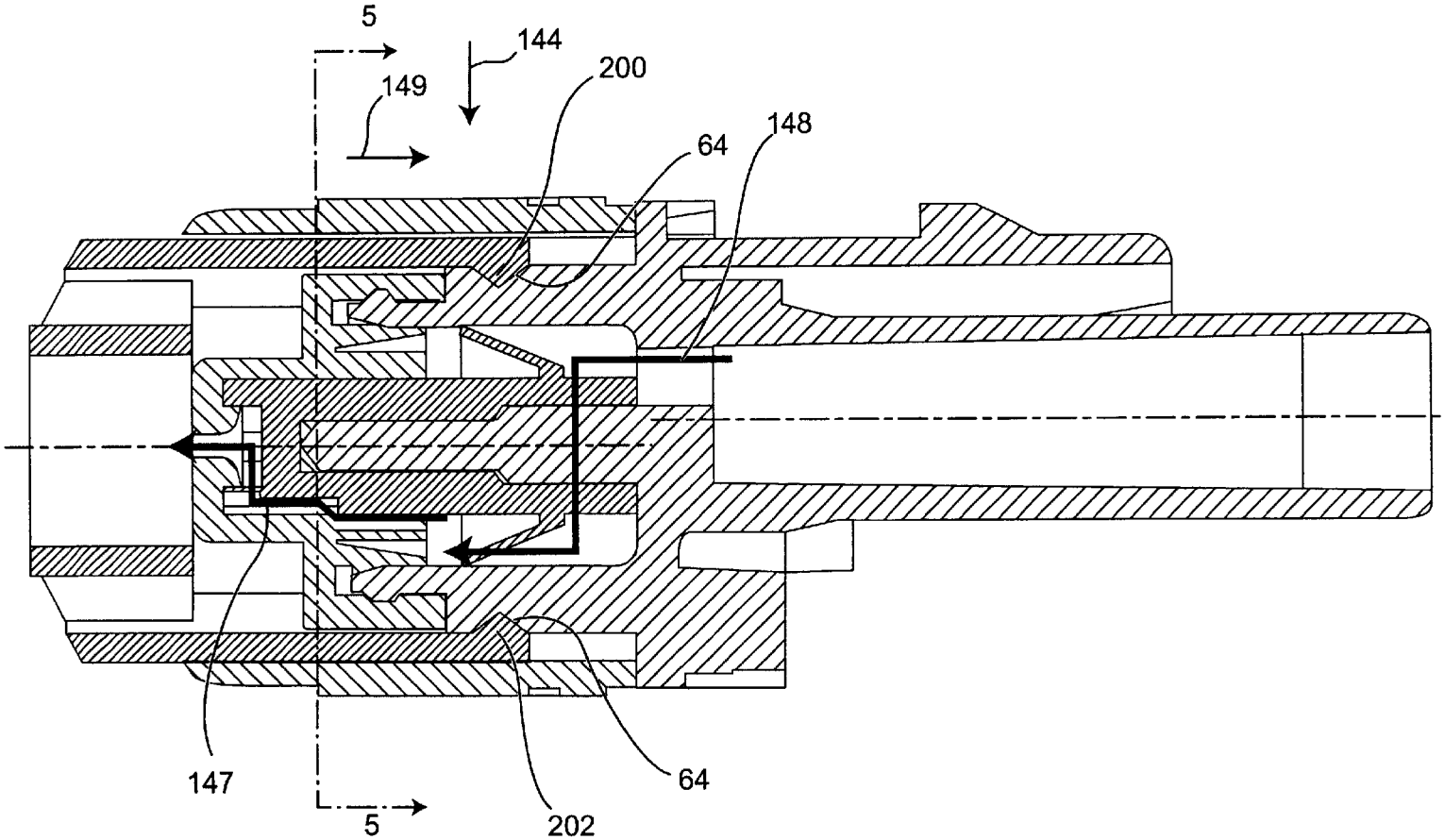
FIG. 10 is a cross-sectional view similar to FIG. 4 showing the components in the foam position and showing the flow of spray materials.
Figure 11:
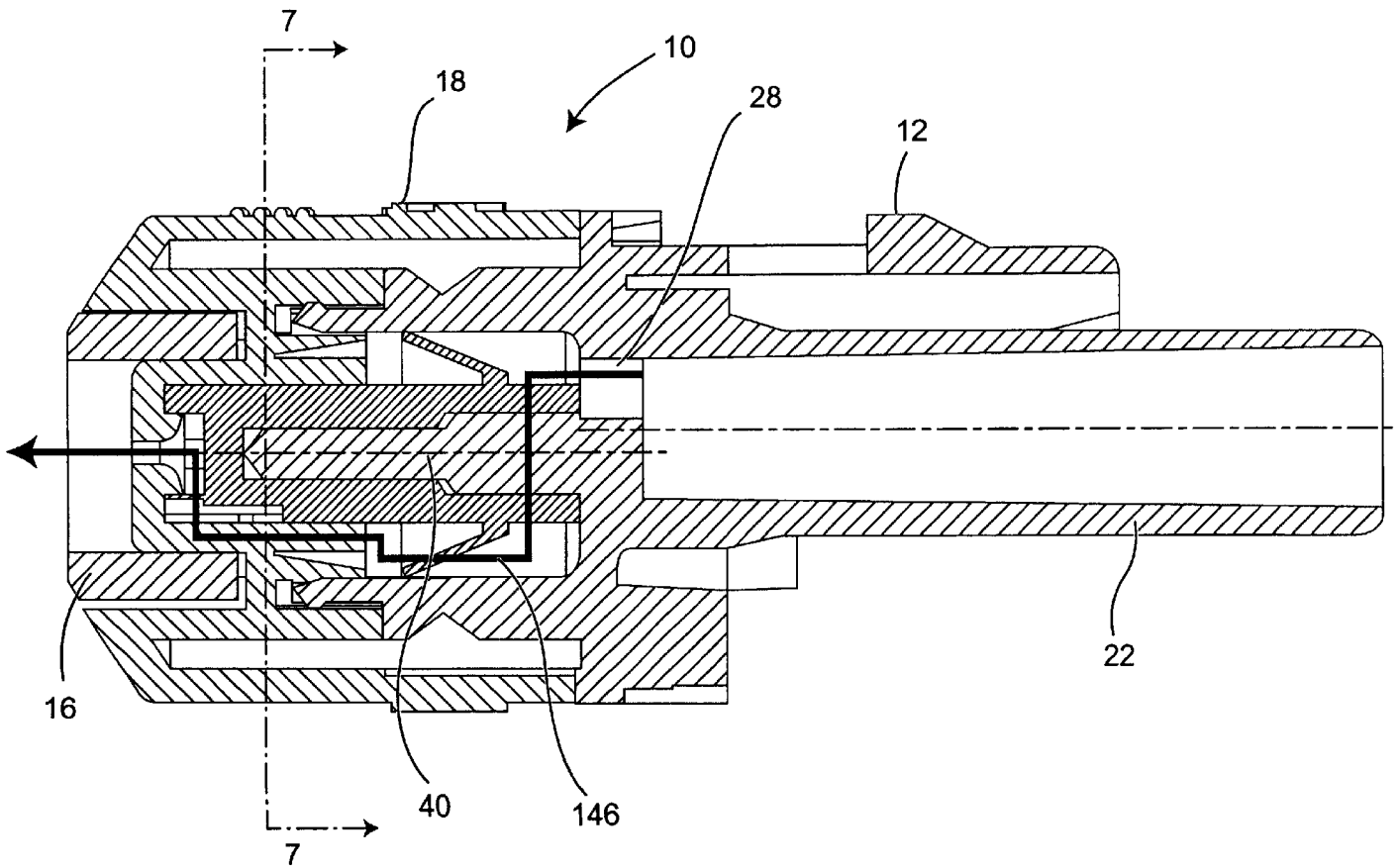
FIG. 11 is a cross-sectional view similar to FIG. 6 showing the components in the spray position, and showing the flow of spray material.

The guide legs 172, 174 project through apertures 192, 194 which are formed in the cap member 18 so that rotation of the cap member 18 causes rotation of the foamer tube 16. The end portions 196, 198 of the guide legs 172, 174 each have a cam follower boss 200, 202 that engage with the cam groove 64 in the nozzle member 12 as is shown in FIG. 10.

The exterior side wall portions 86, 88, 90, 92 of the cap have the following integrally molded indicia formed thereon, respectively, "off", "foam", "spray" and "foam" 204, 206, 208, 210. Rotation of the cap 18 in one direction 212 shown by the arrow in FIG. 1 from the "off" position as shown in FIGS. 2 and 3 to the "foam" position shown in FIGS. 4 and 5 rotates the foamer tube 16 and as a result the cam groove 64 drives the foamer tube 16 to the extended position shown in FIG. 4.

Figure 4:
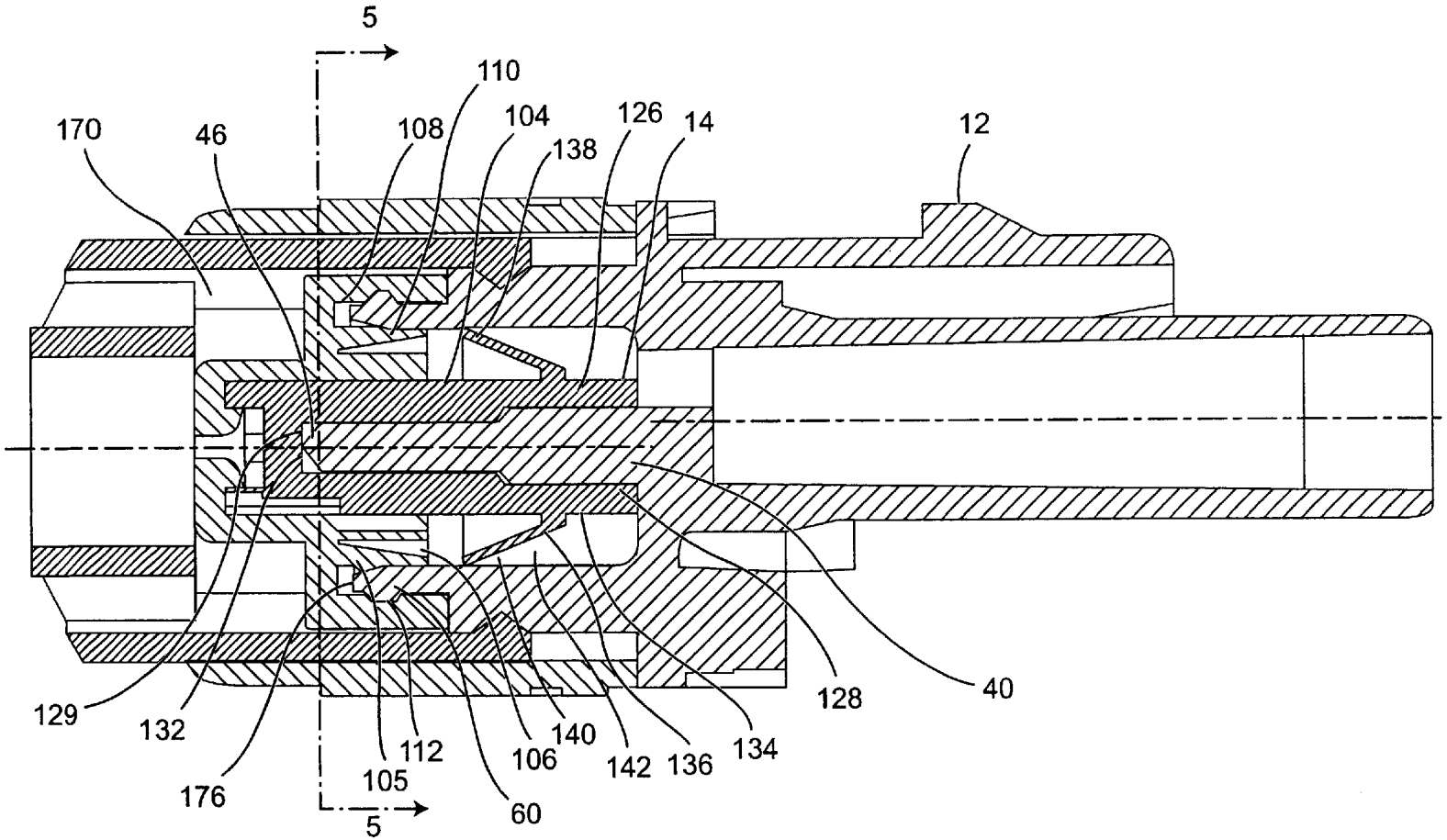
FIG. 4 is a cross-sectional view taken along the line 2—2 of FIG. 1, similar to FIG. 2 but showing the components in the foam-position.
Figure 5:
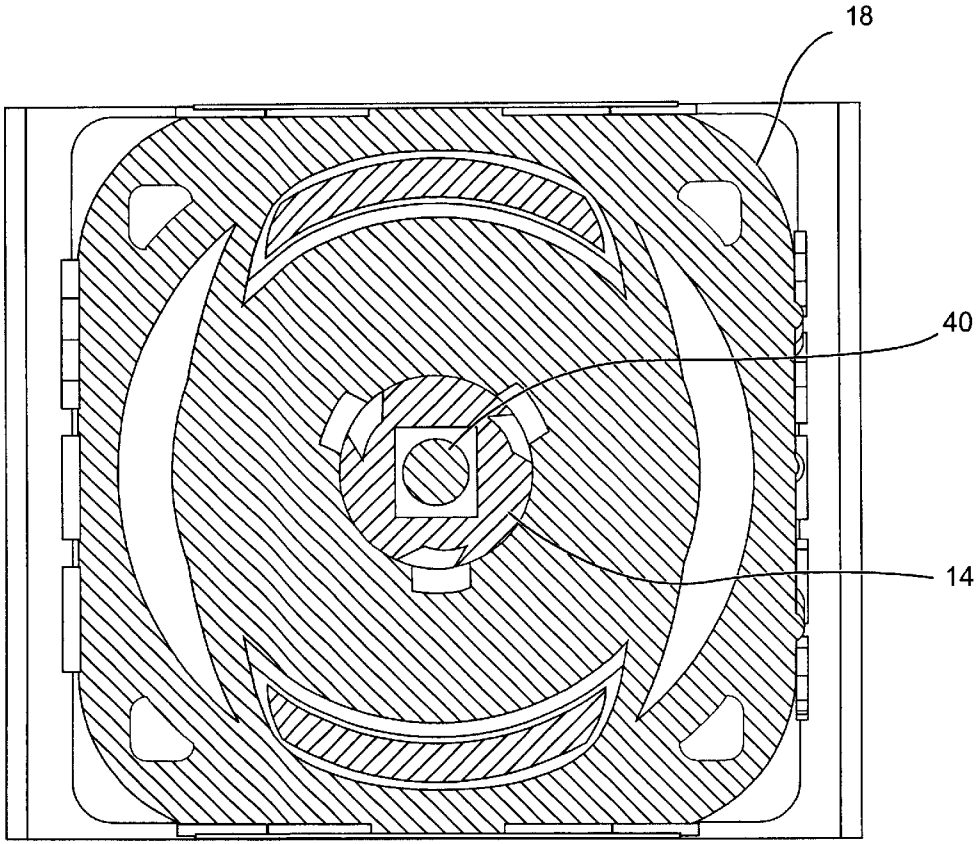
FIG. 5 is a cross-sectional view taken along the line 5—5 of FIG. 4.
Figure 7:
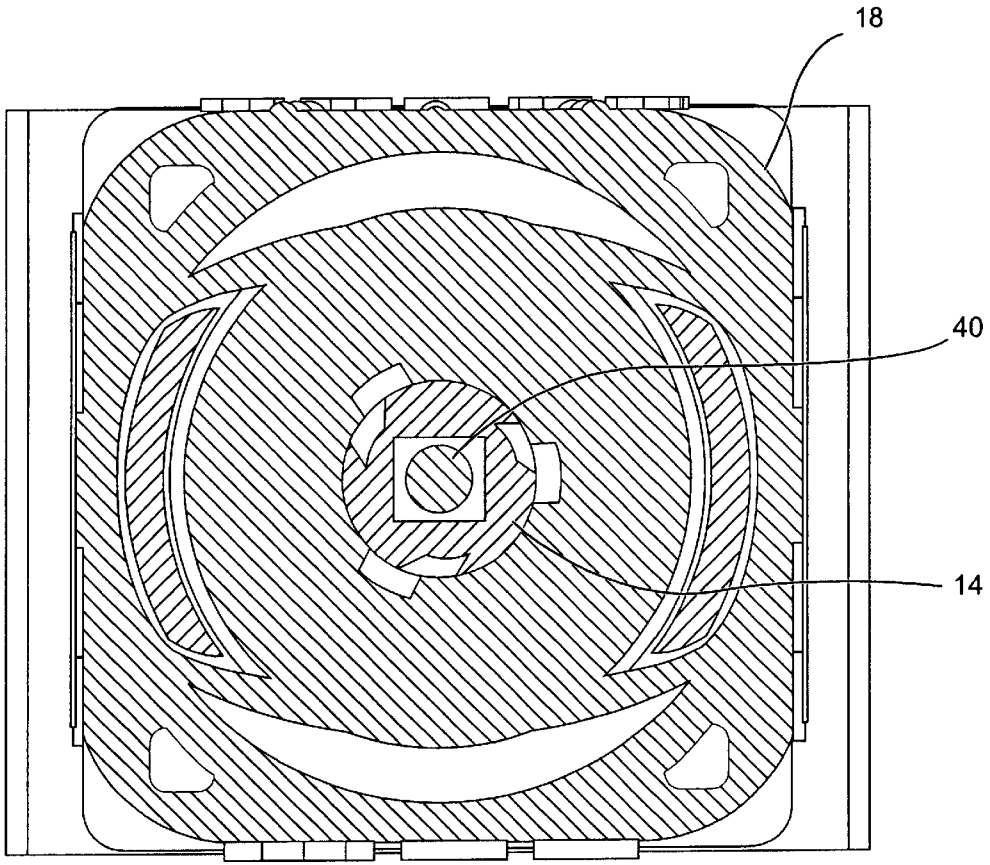
FIG. 7 is a cross-sectional view taken along the line 7—7 of FIG. 6.
Figure 8A:
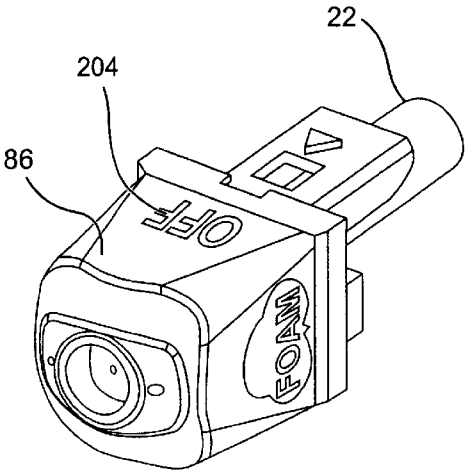
FIGS. 8A through 8D are fragmentary perspective views showing the components in the off-position, the foam-position, the spray-position and the further foam-position, respectively, as the cap is rotated successively in the counterclockwise direction starting from the off-position.
Figure 8B:
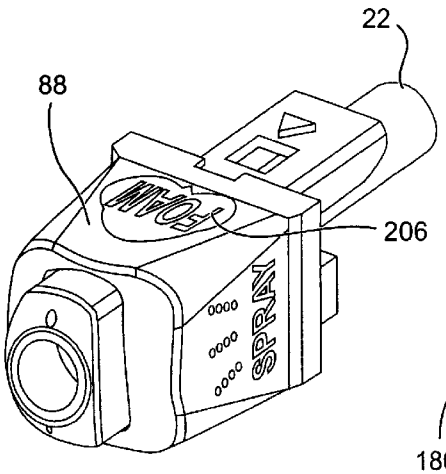
Figure 8C:
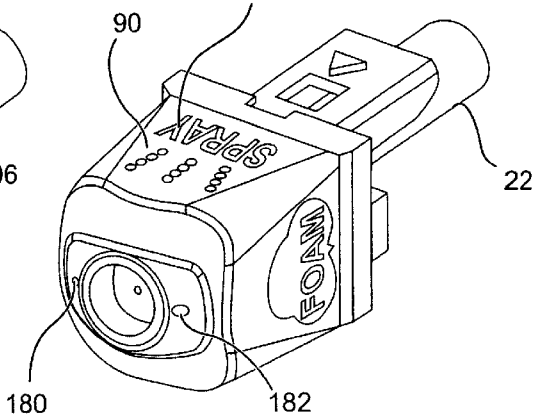
Figure 8D:
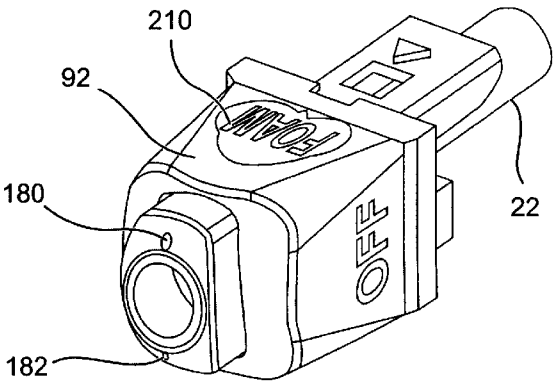

Continued rotation of the cap member 18, in the order of ninety (90) degrees, in the direction shown by the arrow 114 in FIG. 1 from the "foam" position shown in FIGS. 4 and 5 to the "spray" position shown in FIGS. 6 and 7 again rotates the foamer tube 16 and as a result the cam groove 64 drives the foamer tube 16 to its retracted position shown in FIG. 6.

Further rotation of the cap member 18, in the order of ninety (90) degrees, in the direction shown by the arrow 112 in FIG. 1 from the "spray" position shown in FIGS. 6 and 7 again rotates the foamer tube to the extended position shown in FIG. 4.

Still further rotation of the cap member 18, in the order of an additional ninety (90) degrees brings the cap 18 again to the "off" position which is shown in FIGS. 2 and 3.

FIG. 10 shows the various components in the foam position and the direction of the liquid flow of spray material is illustrated by the arrows 147, 148. The liquid spray material flows from the feed tube 22 via the port 28 into the cavity 32 and the channel 33. The spray material in the liquid state enters the liquid spinner face 150 through at least two of the three apertures 152, 154, 156 that are formed in the spinner body.

The liquid enters the spinner face 150 in a direction that is generally tangential to the outer surface 162 of the spinner member 14 resulting in a spin action on the liquid spray material. The spin action in combination with the velocity of the liquid and the compressed area of the liquid action results in atomization of the liquid.

During operation in the "foam" position, the foamer tube 16 projects beyond the cap member and the flow of spray material discharged through the foamer tube 16 creates a venturi action which causes air to be drawn into the foamer tube 16 through the air openings 180, 182. This flow of air mixes with the liquid spray which has been atomized by the spinner member 12 resulting in the creation of a foam.

The outside air flows through the air openings 180, 182 in the direction shown by the arrow 218 in FIG. 9. This direction is opposite to the direction of the flow of spray material which flows through the telescoping foamer nozzle 10 as shown by the arrows 214, 216 in FIGS. 10 and 11. The opposing flow directions of the air and the spray material as the air and the liquid of the spray material start the mixing process, combined with the action of the spinner 14 in atomizing the flow of liquid results in the effective production of a foam product.

Rotation of the cap 18 to the spray position halts the production of foam and allows the discharge of the liquid as a spray material.

The telescoping foamer nozzle 10 thus provides a means for rapidly and efficiently switching from discharging a liquid spray product to discharging a foam product in a reversible manner.

Figure 12:
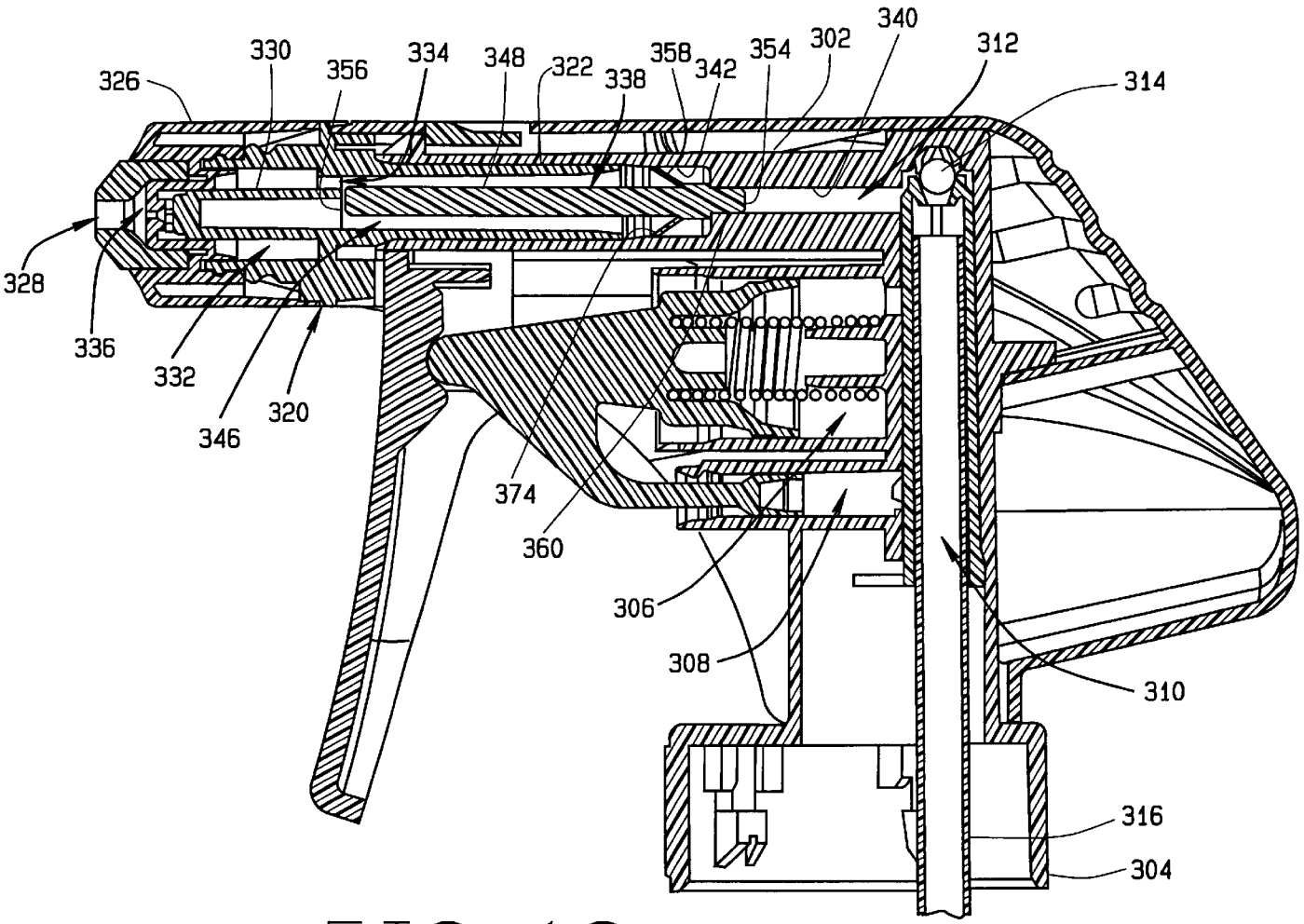
FIG. 12 is a side elevation view in section of a further embodiment of the trigger sprayer of the invention employing a variant embodiment of a valve in the liquid passage of the trigger sprayer.

A further embodiment of the trigger sprayer of the invention is shown in FIG. 12. Many of the component parts of the embodiment of the trigger sprayer shown in FIG. 12 are the same as those of the previously described trigger sprayer embodiment.

The trigger sprayer of FIG. 12 includes a sprayer housing 302 that has an integral connector cap 304 for attaching the sprayer housing to a separate container of liquid to be dispensed by the trigger sprayer. A pump chamber 306 and vent chamber 308 are also formed in the sprayer housing, as is conventional. The housing 302 also includes a liquid supply passage 310 and a liquid discharge passage 312. The liquid supply passage 310 communicates with the pump chamber 306 through a ball check valve 314. A dip tube 316 is mounted in the liquid supply passage 310 and extends downwardly into the liquid contained in a liquid container to which the sprayer is attached. The liquid discharge passage 312 also communicates with the pump chamber 306 and forms a part of the downstream liquid passage from the pump chamber 306 through the sprayer housing 302 to a nozzle assembly 320 attached to the sprayer housing 302.

The nozzle assembly 320 is similar in construction to the previously described embodiment in that it comprises a feed tube 322 having an interior bore 324 that forms a portion of the liquid passage that extends downstream from the pump chamber 306. The nozzle assembly 320 also has a cap 326 with a nozzle exit port or liquid discharge orifice 328 that discharges liquid pumped through the trigger sprayer. However the nozzle assembly 320 of FIG. 12 differs from the previously described embodiment in that it does not comprise a post or shaft on which is mounted a separate liquid spinner and conical check valve. Instead, the nozzle assembly 320 has an integral liquid spinner 330 contained in a liquid spinner chamber 332 of the nozzle assembly. Liquid pumped through the nozzle assembly 320 is directed through the interior bore 324 of the feed tube 322, and through a port 334 that communicates the feed tube interior bore 324 with the interior of the liquid spinner chamber 332 of the nozzle assembly. Liquid pumped into the spinner chamber 332 flows along axial grooves in the exterior surface of the liquid spinner 330 to radial grooves at the distal end of the liquid spinner that communicates with the swirl chamber 336 of the spinner. The liquid passes through the swirl chamber 336 of the liquid spinner and is discharged through the discharge orifice 328 just as in the previously described embodiment.

The trigger sprayer embodiment of FIG. 12 also differs from the previously described embodiment in that the valve that controls the flow of liquid in the downstream direction from the pump chamber 306 to the sprayer discharge orifice 328 is a separate component part from the liquid spinner 330. The valve 338 is also positioned in the liquid passage further upstream of the liquid spinner 330.

To accommodate the particular construction of the valve 338, the liquid discharge passage 312 of the trigger sprayer is provided with a upstream section 340 having an interior surface with a reduced interior diameter, and a downstream section 342 having an interior surface with an enlarged interior diameter. An annular wall 344 extends from the interior surface of the discharge passage upstream section 340 to the interior surface of the discharge passage downstream section 342. The interior surface of the discharge passage downstream section 342 is dimensioned to receive the nozzle sprayer feed tube 322 in a tight friction fit just as in the previously described embodiment of the trigger sprayer. An outlet opening 346 is provided in the sprayer housing 302 that opens to the discharge passage downstream section 342. The feed tube 322 of the nozzle assembly is inserted through the outlet opening 346 into the discharge passage 312 in assembling the nozzle assembly 320 to the sprayer housing 302.

Figure 14:
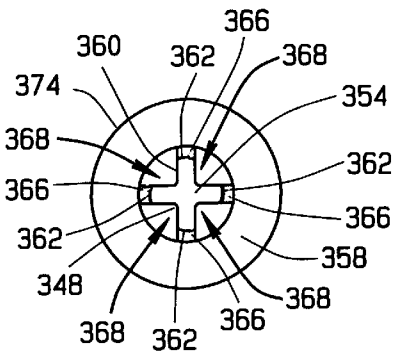
FIG. 14 is an end view of the valve shown in FIG. 13 removed from the trigger sprayer.

The valve 338 of the invention has an elongate center shaft 348 with a center axis 350. The valve is symmetric about the center axis 350. The shaft 348 extends along the length of the valve from an upstream end 354 of the shaft to a downstream end 356 of the shaft. A conical flange 358 of the valve projects outwardly from the shaft 348 adjacent the upstream end 352. A portion of the shaft adjacent its upstream end 354 functions as a positioning plug 360. The positioning plug 360 of the shaft has a t-shaped cross section as seen in FIG. 14. In addition, the radially opposite exterior surfaces 362 of the t-shaped positioning plug are radially spaced from each other a distance that corresponds to the interior diameter of the discharge passage upstream section 340. This enables the positioning plug 360 to be inserted into the discharge passage upstream section 340 and held securely therein in friction engagement between the positioning plug exterior surfaces 362 and the interior surface of the discharge passage upstream section 340. As the exterior surfaces 362 of the positioning plug extend from the shaft upstream end 352 toward the conical flange 358, they each are formed with a radially outward step that provides a shoulder surface 366. Each shoulder surface engages against the annular wall 344 of the discharge passage 312 in properly positioning the plug 360 in the discharge passage upstream section 340.

The valve 338 is held in position in the liquid discharge passage 312 with the valve center axis 350 coaxial with the discharge passage center axis solely by the engagement of the positioning plug exterior surfaces 362 with the discharge passage upstream section interior surface 340 and by the engagement of the positioning plug shoulder surfaces 366 with the annular wall 344 of the discharge passage 312.

The t-shaped cross section of the positioning plug 360 defines four axial liquid channels 368 that extend along the positioning plug. The liquid channels 368 provide fluid communication through the portion of the discharge passage upstream section 340 into which the positioning plug is inserted. The entire axial length of the valve shaft 348 could be given the t-shaped cross section configuration of the positioning plug 360, or only the portion of the shaft between the shaft upstream end 354 and the conical flange 358 need be given the t-shaped cross section configuration with the remainder of the length of the shaft from the conical flange 358 to the shaft downstream end 356 having a circular cross section.

Figure 13:
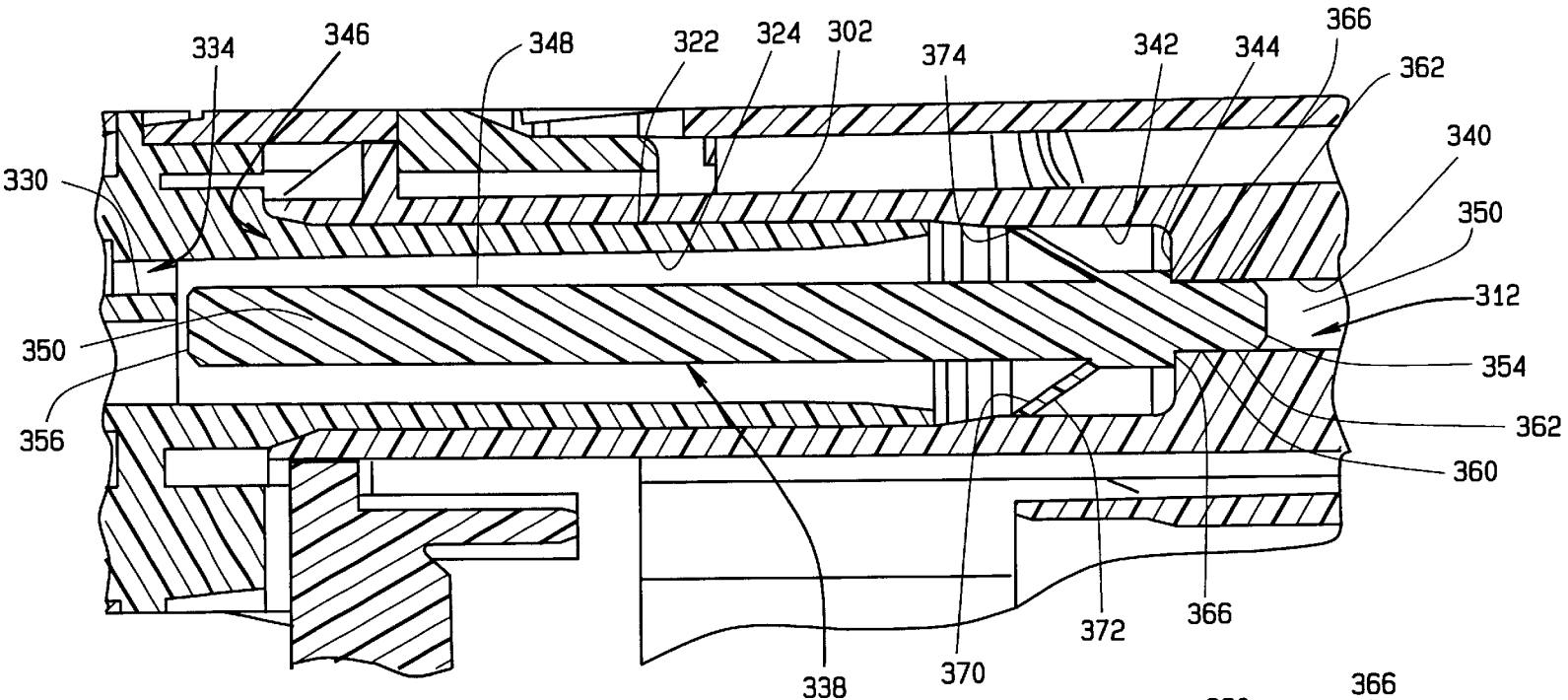
FIG. 13 is an enlarged partial view of the valve of FIG. 12.

The conical flange 358 of the valve has opposite interior 370 and exterior 372 surfaces that project toward the shaft downstream end and radially outwardly from the shaft to a circular peripheral edge 374 of the flange. As best seen in FIG. 13, the conical flange 358 between its interior 370 and exterior 372 surfaces is relatively thin, giving the flange a flexibility and resiliency. In addition, the circular peripheral edge 374 of the conical flange is given an exterior diameter dimension that corresponds to the interior diameter dimension of the discharge passage downstream section 342 so that the resiliency of the flange causes the peripheral edge 374 to engage in a sealing contact with the interior surface of the discharge passage downstream section 342.

It can be seen in FIG. 13 that when the valve 338 is assembled into the liquid discharge passage 312 by inserting the positioning plug 360 in the discharge passage upstream section 340, the length of the valve shaft 348 positions the shaft downstream end 356 outside of the discharge passage downstream section 342. The length of the shaft 348 to its downstream end 356 passes through the discharge passage downstream section 342 and through the outlet opening 346 in the sprayer housing with the shaft downstream end 356 projecting outwardly from the outlet opening. This dimensioning of the length of the shaft 348 so that its downstream end 356 projects out of the outlet opening 346 provides a portion of the shaft adjacent the downstream end 356 that can be gripped either manually or by a machine facilitating the assembly of the valve 338 into the liquid discharge passage 312 of the sprayer.

As shown in FIG. 13, the valve 338 is first assembled into the liquid discharge passage 312 of the sprayer housing prior to the nozzle assembly 320 being assembled into the liquid discharge passage. When the feed tube 322 of the nozzle assembly 320 is inserted through the sprayer housing outlet opening 346 and into the liquid discharge passage 312, the nozzle assembly 320 does not engage with the valve shaft 348. The valve shaft downstream end 356 remains spaced from the end of the liquid spinner 330 of the nozzle assembly. This prevents the nozzle assembly 320 from exerting a compressive force on the valve shaft 348 that could cause the shaft to deflect or bend along its axial length which could degrade the seal between the conical flange peripheral edge 374 and the interior surface of the discharge passage 312.

In operation of the valve, when the trigger sprayer is manually operated and liquid is pumped from the pump chamber 306 through the liquid discharge passage 312, the pressure of the liquid will act upon the conical flange exterior surface 372 radially compressing or collapsing the conical flange inwardly toward the valve shaft 348. This separates the flange peripheral edge 374 from its engagement with the interior surface of the liquid passage downstream section 342 opening the valve and allowing liquid to pass through the liquid discharge passage 312 to the nozzle assembly 320 where it is discharged from the trigger sprayer. When the liquid under pressure is removed from the exterior surface 372 of the valve conical flange 358, the resiliency of the flange causes it to expand radially outwardly to its original position shown in FIG. 13 where the flange peripheral edge 372 again engages in sealing contact with the interior surface of the discharge passage downstream section 342 preventing the passage of air or liquid in a reverse direction upstream through the liquid discharge passage 312.

Although the trigger sprayer of the invention has been described above by reference to specific embodiments of the sprayer, it should be understood that other variations of the sprayer may be arrived at without departing from the invention's scope of protection provided by the following claims. For example, the valve conical flange could be replaced by a circular flange with a centering positioning post where the circular flange has a peripheral edge that seals against the annular wall 344 of the liquid discharge passage.

What is claimed is:

1. A manually operable trigger sprayer comprising:

a sprayer housing;

a pump on the sprayer housing;

a nozzle exit port on the sprayer housing;

a liquid discharge passage extending through the sprayer housing, the liquid discharge passage communicating the pump with the nozzle exit port to conduct a flow of liquid in a downstream direction through the liquid discharge passage to the nozzle exit port;

a valve positioned in the liquid discharge passage, the valve having a conical flange with a center axis that defines axial and radial directions, the conical flange being radially flexible whereby the conical flange flexes radially inwardly when subjected to liquid under pressure flowing through the liquid discharge passage in the downstream direction toward the nozzle exit port to open the liquid discharge passage and allow the liquid to pass the conical flange, and whereby the conical flange flexes radially outwardly when it is not subjected to liquid under pressure flowing through the liquid discharge passage to close the liquid discharge passage, the valve having a positioning plug that projects from the conical flange and engages with an interior surface of the liquid discharge passage to hold the valve centered in the liquid discharge passage;

a shaft extending through a portion of the liquid discharge passage;

a liquid spinner positioned in the liquid discharge passage, the liquid spinner having a spinner cavity adjacent the nozzle exit port; and the liquid spinner being at one end of the shaft with the conical flange being at an opposite end of the shaft.

2. The trigger sprayer of claim 1, further comprising:

the conical flange extending radially outwardly as the conical flange extends downstream in the liquid passage.

3. The trigger sprayer of claim 1, further comprising:

the liquid discharge passage interior surface surrounds the liquid discharge passage; and the conical flange having a circular peripheral edge that engages with the liquid discharge passage interior surface when the valve is not subjected to liquid under pressure flowing through the liquid discharge passage.

4. The trigger sprayer of claim 1, further comprising:

the conical flange being on the shaft and projecting radially outwardly from the shaft.

5. The trigger sprayer of claim 1, further comprising:

the valve being a separate component part of the trigger sprayer from the liquid spinner.

6. The trigger sprayer of claim 1, further comprising:

the shaft being separate and spaced from the liquid spinner.

7. The trigger sprayer of claim 1, further comprising:

the engagement of the positioning plug with the liquid discharge passage interior surface solely holding the valve in the liquid discharge passage.

8. The trigger sprayer of claim 7, further comprising:

a nozzle assembly containing the liquid spinner, the nozzle exit port being on the nozzle assembly and a feed tube projecting from the nozzle assembly and into the liquid discharge passage.

9. The trigger sprayer of claim 1, further comprising:

the positioning plug having at least one liquid flow channel extending along the positioning plug, the liquid flow channel forming a part of the liquid discharge passage.

10. The trigger sprayer of claim 1, further comprising:

the positioning plug having a t-shaped cross section.

11. A manually operable trigger sprayer comprising:

a sprayer housing;

a pump on the sprayer housing;

a nozzle exit port on the sprayer housing;

a liquid discharge passage extending through the sprayer housing, the liquid discharge passage communicating the pump with the nozzle exit port to conduct a flow of liquid in a downstream direction through the liquid discharge passage to the nozzle exit port;

a valve positioned in the liquid discharge passage, the valve having a conical flange with a center axis that defines axial and radial directions, the conical flange being radially flexible whereby the conical flange flexes radially inwardly when subjected to liquid under pressure flowing through the liquid discharge passage in the downstream direction toward the nozzle exit port to open the liquid discharge passage and allow the liquid to pass the conical flange, and whereby the conical flange flexes radially outwardly when it is not subjected to liquid under pressure flowing through the liquid discharge passage to close the liquid discharge passage, the valve having a positioning plug that projects from the conical flange and engages with an interior surface of the liquid discharge passage to hold the valve centered in the liquid discharge passage;

the engagement of the positioning plug with the liquid discharge passage interior surface solely holding the valve in the liquid discharge passage;

the sprayer housing having a discharge passage outlet opening that opens to the liquid discharge passage in the sprayer housing; and the valve having a shaft that projects from the conical flange on an opposite side of the conical flange from the positioning plug, the shaft extending through the discharge passage from the conical flange toward the discharge passage outlet opening.

12. The trigger sprayer of claim 11, further comprising:

the shaft extending through the discharge passage outlet opening and outwardly from the discharge passage.

13. A manually operable trigger sprayer comprising:

a sprayer housing;

a nozzle exit port on the sprayer housing;

a manually operated liquid pump in the sprayer housing;

a liquid passage communicating the liquid pump with the nozzle exit port for conducting a flow of liquid in a downstream direction from the liquid pump to the nozzle exit port;

a valve in the liquid passage, the valve having a flange with a center axis that defines axial and radial directions, the flange extending radially outwardly to a peripheral edge of the flange that engages against an interior surface of the liquid passage to close the liquid passage and flexes away from the interior surface to open the liquid passage, the valve having a positioning plug that projects from the flange and engages with the interior surface of the liquid passage to hold the valve centered in the liquid passage;

the sprayer housing having an outlet opening that opens to the liquid passage; and the valve having a shaft that projects from the conical flange in the downstream direction toward the outlet opening.

14. The trigger sprayer of claim 13, further comprising:

the valve flange being conical with a circular peripheral edge that engages with the interior surface.

15. The trigger sprayer of claim 14, further comprising:

the conical flange being flexible whereby the conical flange flexes radially inwardly separating from the interior surface in response to the conical flange being subjected to the flow of liquid in the downstream direction from the liquid pump to the nozzle exit port and the conical flange flexes radially outwardly into engagement with the interior surface in response to the conical flange not being subjected to the flow of liquid in the downstream direction from the liquid pump to the nozzle exit port.

16. The trigger sprayer of claim 14, further comprising:

the valve positioning plug projects from the conical flange in an upstream direction, opposite the downstream direction, the positioning plug engaging with the liquid passage interior surface solely positioning the conical flange in the liquid passage.

17. The trigger sprayer of claim 16, further comprising:

the positioning plug having at least one liquid flow channel extending along the positioning plug, the liquid flow channel forming a part of the liquid passage.

18. The trigger sprayer of claim 13, further comprising:

the shaft extending through the outlet opening and projecting outwardly from the liquid passage.

* * * * *